United States Patent [19]

Solomon

[11] Patent Number: 4,505,388

[45] Date of Patent: Mar. 19, 1985

[54] EXPANDABLE PORTABLE FILE

[75] Inventor: Jack Solomon, Long Beach, N.Y.

[73] Assignee: Esselte Pendaflex Corporation, Garden City, N.Y.

[21] Appl. No.: 448,034

[22] Filed: Dec. 8, 1982

[51] Int. Cl.[3] ..... B65D 85/62

[52] U.S. Cl. ..... 206/425; 206/45.13; 206/508; 206/509; 312/184

[58] Field of Search ..... 206/45.13, 425, 503, 206/506, 507, 508, 509, 510, 511, 512; 220/94 R, 324, 326, 334, 335, 22.1, 22.2, 22.3, 22.4, 22.5; 312/184, 185

[56] References Cited

U.S. PATENT DOCUMENTS

| | | | |
|---|---|---|---|
| 1,859,228 | 5/1932 | Berry | 220/94 R |
| 2,180,997 | 11/1939 | Rubilino | 220/324 |
| 2,201,547 | 5/1940 | Scheiman | 206/425 |
| 2,506,844 | 5/1950 | Smith | 206/511 |
| 2,967,079 | 1/1961 | Parvis | 312/184 |
| 3,018,876 | 1/1962 | Huot | 220/335 |
| 3,270,922 | 9/1966 | Schmidt | 206/509 |
| 3,281,193 | 10/1966 | Murray | 312/184 |
| 3,368,721 | 2/1968 | Wiskochil | 206/509 |
| 3,756,451 | 9/1973 | Popeil | 220/94 R |
| 4,325,595 | 4/1982 | Solomon | 206/45.18 |

FOREIGN PATENT DOCUMENTS

| | | | |
|---|---|---|---|
| 2303725 | 10/1976 | France | 206/503 |
| 2428576 | 2/1980 | France | 206/509 |

*Primary Examiner*—George E. Lowrance
*Assistant Examiner*—Jimmy G. Foster
*Attorney, Agent, or Firm*—Darby & Darby

[57] ABSTRACT

A portable file comprises a case formed with two side panels, a front panel, a back panel, a bottom and a top. The two side panels, back panel and bottom form an integral structure. A first hinge connects the integral structure and the rear end of the top and permits pivoting movement of the top between a closed position and an open position. A second hinge connects the integral structure and the bottom of the front panel and permits pivoting movement of the front panel between a closed position and an extended position. A latch connects the top and the front panel whereby they can be releasably retained in their respective closed positions, and a handle is connected to the case whereby it can be carried. The side panels are formed with supports for a plurality of hanging files, and the top is formed with a retainer cooperating with the supports for retaining the hanging files on the supports when the top is in the closed position, notwithstanding tipping of the case. The top can be pivoted through an arc exceeding 90°, whereby it rests stably in the open position by virtue of its own weight, and the front panel is capable of pivoting through an arc such that the top thereof in the extended position swings out a distance sufficient to permit finger access to hanging files stored in the case even when the case is filled to rated capacity.

21 Claims, 4 Drawing Figures

EXPANDABLE PORTABLE FILE

BACKGROUND OF THE INVENTION

This invention relates to files and, more particularly, to a novel and highly-effective portable file case that expands when in use to permit finger access to hanging files stored therein, even when the several hanging files and the file case itself are filled to rated capacity, and that retracts to a closed position for compact storage.

In order to be acceptable to users, portable files must be light and compact. At the same time, for maximum utility, they must be reasonably commodious. Moreover, they must store their contents securely and in a manner that provides easy access.

Large filing cabinets that are not meant to be portable are normally made of metal and have pull-out drawers equipped with movable stops that can be adjusted to provide the proper amount of finger access to files stored therein. These design features are inappropriate in portable files because of the excessive weight they entail.

The portable files heretofore available have had many drawbacks. A primary drawback is that, when filled to capacity, they become difficult to use since there is then inadequate finger access to the files. If they are not filled to capacity, thereby leaving room for finger access, storage density is reduced. This requires more file cases and closet space in order to accommodate all of the files to be stored.

Another disadvantage of conventional portable files is that, when accidentally tipped, their contents tend to spill out within the case, and, when accidentally dropped, they tend to fly open and spew their contents on the floor. In both circumstances, the least of the inconvenience is the physical retrieval of loose papers. Of greater concern is the need to examine papers individually in order to return them to their proper files; this taks can be very time-consuming.

Conventional portable files also have the shortcomings that they are not readily stackable, thereby increasing the likelihood of accidental tipping and spillage; and that, being made of a light but relatively flexible material such as plastic, movable parts such as a hinged top tend to flex under pressure in such a manner as to override their mating structures in the closed position, thereby compromising the integrity of the enclosure.

SUMMARY OF THE INVENTION

An object of the invention is to remedy the problems of conventional portable files outlined above and, in particular, to provide a portable file case that provides adequate finger access to files stored therein even when filled to rated capacity, that holds the file contents securely even when accidentally tipped or dropped, that is readily stackable, and that is sufficiently rigid to maintain the integrity of the enclosure notwithstanding the relatively flexible material of which it is made.

The foregoing and other objects are attained in a portable file comprising a case formed with two side panels, a front panel, a back panel, a bottom and a top. The two side panels, back panel and bottom form an integral structure.

First hinge means connects the integral structure and the rear end of the top and permits pivoting movement of the top between a closed position and an open position. Second hinge means connects the integral structure and the bottom of the front panel and permits pivoting movement of the front panel between a closed position and an extended position.

A latch is connected to the top and the front panel so that they can be releasably retained in their respective closed positions, and a handle is connected to the case so that it can be carried.

The side panels are formed with support means for supporting a plurality of hanging files inside the case, and the top is formed with retention means cooperating with the support for retaining the hanging files on the support when the top is in the closed position, notwithstanding tipping of the case.

The top is capable of pivoting through an arc exceeding 90° whereby it rests stably in the open position by virtue of its own weight, and the front panel is capable pivoting through an arc such that the top thereof in the extended position swings out a distance sufficient to permmit finger access to hanging files stored in the case even when the case is filled to rated capacity.

A portable file according to the invention is preferably, though not necessarily, characterized also by the following additional features:

The first hinge means comprises a pair of pivot pins each connecting one of the side panels and the top, and the second hinge means comprises another pair of pivot pins, each connecting one of the side panels and the front panel. For maximum security, the latch comprises a U-shaped member pivotally attached to one of the top and front panel and means integrally formed on the other of the top and front panel engageable with the U-shaped member on the insider of the U thereof.

The top is formed with a well, and the handle is pivotally attached to the top and adapted to be pivoted between an extended position in which it can be grasped for carrying and a storage position in which it is wholly accommodated within the well. The handle is formed with finger-hold means, preferably one or more recesses, facilitating grasping of the handle in the storage position, and can be pivoted in either of two directions from the extended position to the storage position. In the storage position, it is flush with the top.

The handle is provided with a pair of integral pivot pins adapted to be respectively inserted into a pair of apertures formed in opposite sides of the top well. The handle is generally U-shaped and formed of polystyrene and can thus be readily assembled with the top by inserting one of the pivot pins into one of the apertures and then sliding the other pivot pin along the opposite side of the well until it pops into the other of the apertures. Notwithstanding the ease of assembly, it does not readily become detached from the top and can be safely used for carrying the file even when the file is filled to rated capacity.

The support means for the hanging files comprises the upper edges of the respective side panels, and the retention means cooperating with the support for retaining the hanging files on the support when the top is in the closed position comprises a pair of shoulders respectively formed on the top, the shoulders being spaced apart from the respective upper edges when the top is in the closed position a distance sufficient to permit hanging files to hang over the respective upper edges, but insufficient to permit the hanging files to become dislodged from the respective upper edges.

The top engages the integral structure formed by the two side panels, back panel and bottom to limit the pivot arc of the top to less than 135°.

The pivoting movement of the front panel is likewise limited, by structuring including a pair of arcuate slots each centered on the pivot axis of the front panel. The slots are formed in a pair of flanges on either side of the front panel, and limit pins are formed in the respective side panels. Each of the limit pins rides in one of the slots to limit the pivoting movement of the front panel. The flanges in which the slots are formed lie in planes which are respectively perpendicular to the main portion of the front panel.

Ridge means is formed on the outside of the bottom to facilitate stacking a plurality of files according to the invention. The ridges are complemental to both the well formed in the top and a peripheral portion of the top. The well and the top are both rectangular, and the ridges comprise a first pair of parallel ridges respectively cooperating with opposite sides of the well and a second pair of parallel ridges respectively cooperating with opposite sides of the top, the ridges of the first pair being perpendicualr to the ridges of the second pair.

Buttress means cooperates with the side panels and top for preventing the top from overriding the side panels and front panel when subjected to pressure in the closed position. The buttress comprises a pair of flanges respectively connected to the side panels and each lying in a horizontal plane and a pair of flanges respectively connected to the top at opposite sides thereof and each lying in a vertical plane, the flanges of one pair respectively abutting the flanges of the other pair in the closed position.

BRIEF DESCRIPTION OF THE DRAWING

A better understanding of the invention may be gained from a consideration of the following detailed description of preferred embodiments thereof, in conjunction with the appended figures of the drawing, wherein.

DESCRIPTION OF THE PREFERRED EMBODIMENTS

Figure 1:
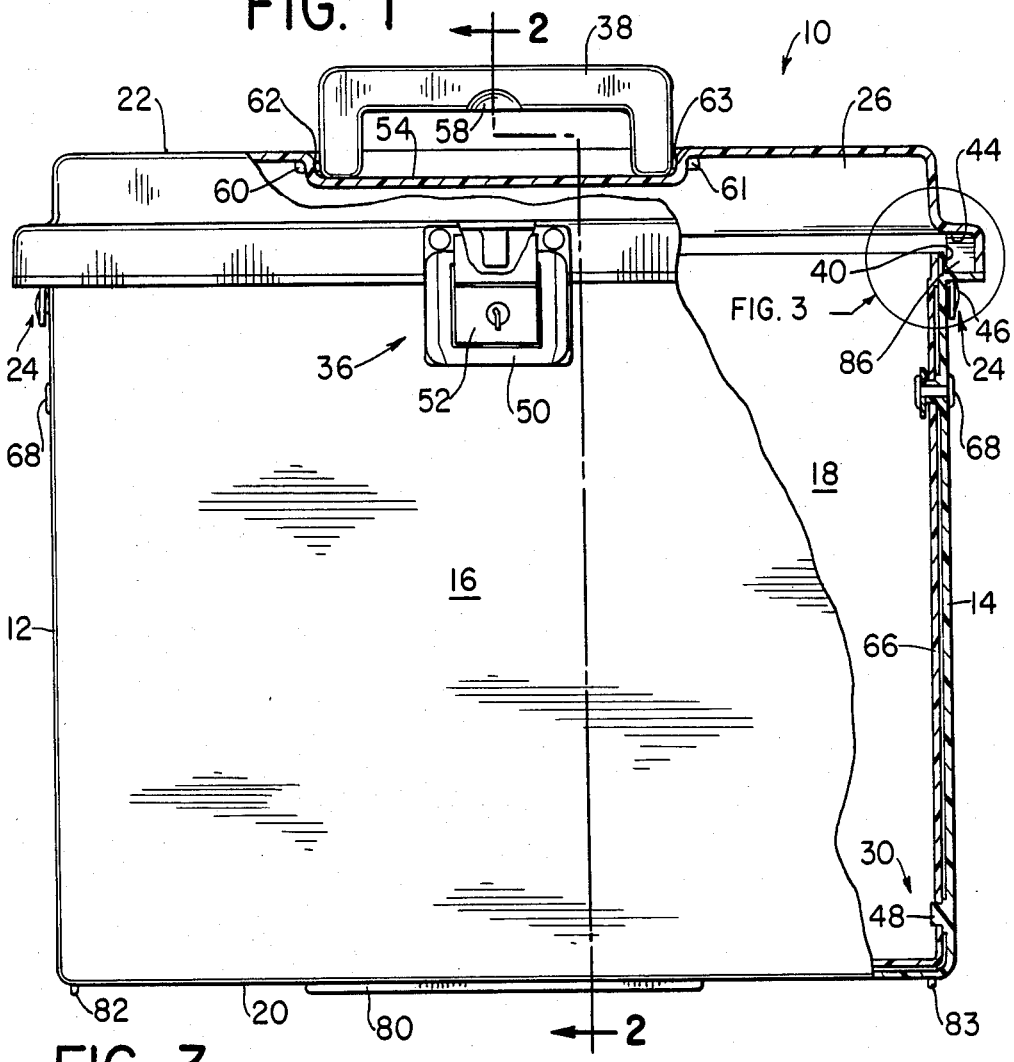
FIG. 1 is a view in front elevation, partly broken away, of a preferred embodiment of a portable file constructed in accordance with the invention.
Figure 2:
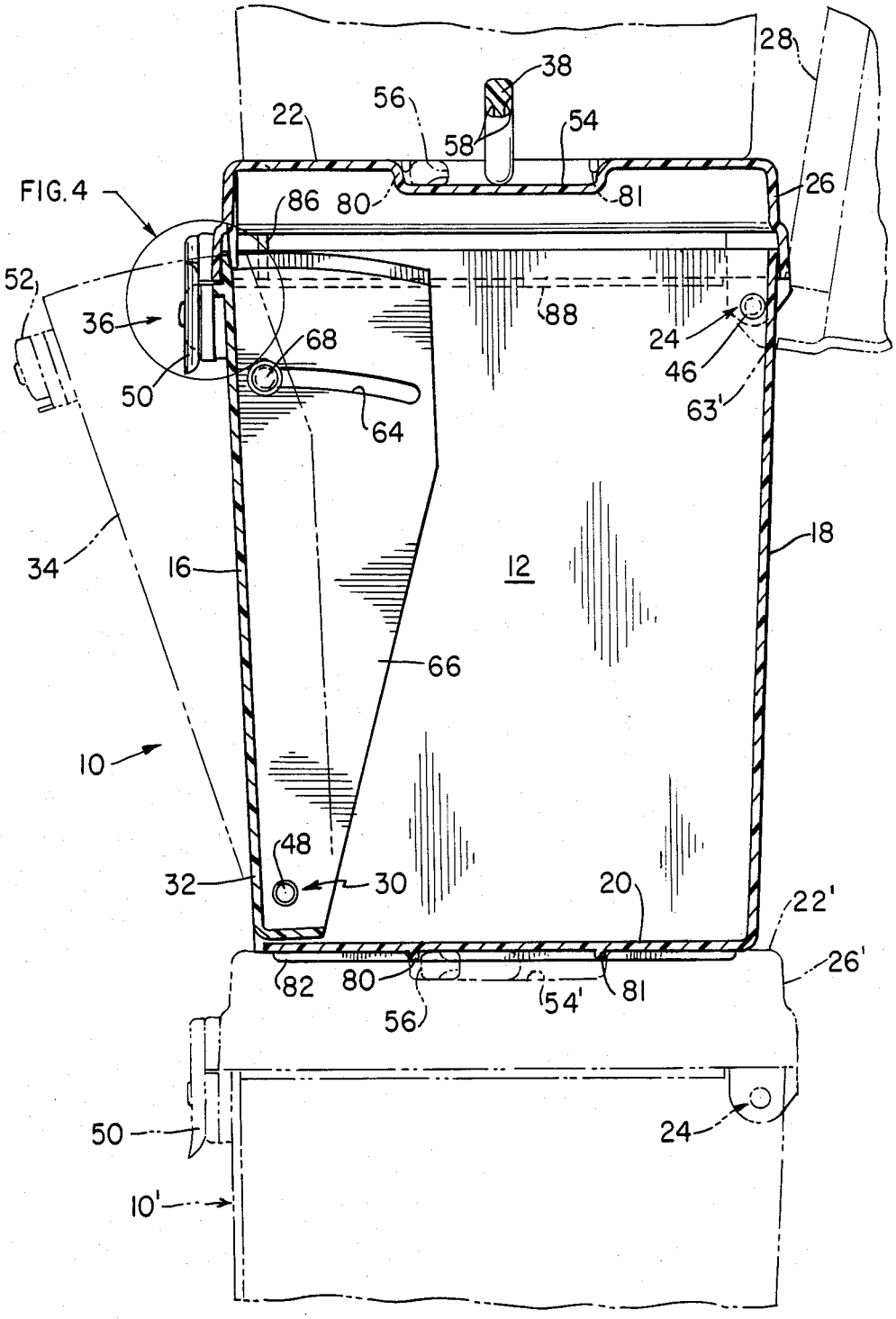
FIG. 2 is a sectional view taken substantially along the broken line 2—2 of FIG. 1, looking in the direction of the arrows, showing in solid and phantom outlines the movements of which portions of the portable file of FIG. 1 are capable, and showing in phantom outline additional portable files according to the invention in stacked relation.

FIGS. 1 and 2 show a portable file 10 constructed in accordance with the invention. The file 10 comprises a case formed with two side panels 12 and 14, respectively, a front panel 16, a back panel 18, and bottom 20 and a top 22. The two side panels 12 and 14, back panel 18 and bottom 20 form an integral structure.

First hinge means 24, 24 connects the integral structure and the rear end 26 of the top 22 and permits pivoting movement of the top 22 about the hinge means 24 between a closed position, illustrated in solid outline in FIG. 2, and an open position, illustrated in phantom outline at 28.

Second hinge means 30, 30 connects the integral structure (formed by the two side panels 12 and 14, the back panel 18 and the bottom 20) to the bottom 32 of the front panel 16 and permits pivoting movement of the front panel 16 about the second hinges 30, 30 between a closed position illustrated in solid outline in FIG. 2 and an extended position illustrated in phantom outline at 34.

A latch 36 is connected to the top 22 and the front panel 16 whereby they can be releasably retained in their respective closed positions, and a handle 38 is connected to the top 22 of the case 10 whereby the case 10 can be carried.

The side panels 12 and 14 are formed with supports 40 (see especially FIG. 3) for supporting a plurality of hanging files 42 inside the case 10. The top 22 is formed with retention means 44 cooperating with the support 40 for retaining the hanging files 42 on the support 40 when the top 22 is in the closed position, notwithstanding tipping of the case 10.

The top 22 is capable of pivoting through an arc exceeding 90°, as FIG. 2 illustrates, whereby it rests stably in the open position by virtue of its own weight.

The front panel 16 is capable of pivoting through an arc such that the top thereof in the extended position swings out a distance sufficient to permit finger access to hanging files stored in the case even when the case 10 is filled to rated capacity (see the position 34 illustrated in FIG. 2).

The first hinges 24, 24 are preferably connected directly to the two side panels 12 and 14, respectively. The hinges 24, 24 may, for example, comprise a pair of pivot pins such as the pin 46 (FIG. 3) connecting one of the side panels 14 to the top 22.

Similarly, the second hinges 30, 30 are preferably connected directly to the side panels 12 and 14. For example, the hinges 30, 30 may comprise a pair of pivot pins, such as the pin 48 (FIG. 1), each connecting one of the side panels and the front panel 16.

The latch 36 comprises a U-shaped member 50 pivotally attached to one of the top and front panel—for example, the top 22—and means integrally formed on the other of the top and the front panel—in this case the front panel 16—engageable with the U-shaped member 50 on the inside of the U thereof.

The handle 38 is preferably connected directly to the top 22. The top 22 is then formed with a well 54, and the handle 38 is pivotally attached to the top 22 and adapted to be pivoted between an extended position shown in solid outline in FIGS. 1 and 2 in which it can be grasped for carrying and a storage position shown in phantom outline at 56 in FIG. 2 in which it is wholly accommodated within the well 54. The handle 38 is formed with finger-hold means such as recesses 58 facilitating grasping of the handle in the storage position.

The handle 38 can be pivoted in either of two directions from the extended position to the storage position, since the well 54 is physically dimensioned to accommodate a clockwise or counter-clockwise pivoting of the handle 38 from the position shown in solid outline in FIG. 2. In either storage position, the handle 38 is flush with the top 22.

A pair of pivot pins 60, 61 connects the handle 38 to the top 22. The pivot pins 60, 61 are integral with the handle 38, and are adapted to be inserted into a pair of apertures 62 and 63 respectively formed in opposite sides of the well 54. The handle 38 is generally U-shaped and formed of polystyrene and can be readily assembled with the top 22 by inserting one of the pivot pins 60 and 61 into one of the apertures 62 or 63 and then sliding the other pivot pin 61 or 60 along the opposite side of the well 54 until it pops into the other of the apertures 63 or 62. Nevertheless, the handle 38 does not readily become detached from the top 22 and can be safely used for carrying the case 10 even when the case 10 is filled to rated capacity.

Figure 3:
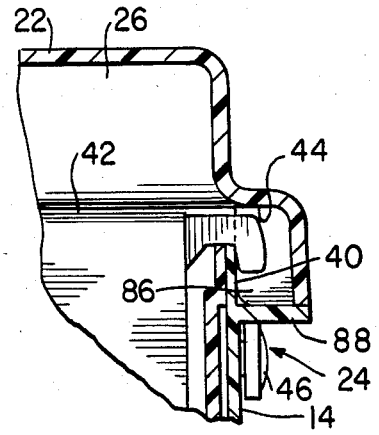
FIG. 3 is a view on a scale enlarged with respect to FIG. 1 showing a portion of the structure thereof.
Figure 4:
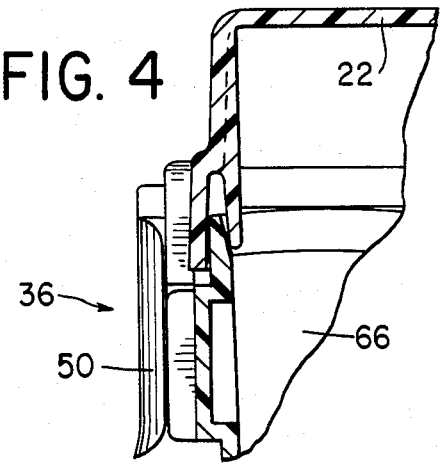
FIG. 4 is a view on a scale enlarged with respect to FIG. 2 showing a portion of the structure thereof.

As shown especially in FIG. 3, the supports 40 comprise the upper edges of the respective side panels 12 and 14. Moreover, the retention means 44 comprises a pair of shoulders respectively formed on the top 22, the shoulders being spaced apart from the respective upper edges 40 when the top 22 is in the closed position a distance sufficient to permit hanging files 42 to hang over the respective upper edges 40 but insufficient to permit the hanging files 42 to become dislodged from the respective upper edges 40.

As shown especially in FIG. 2, the top 22 in the open position engages (at 63') the integral structure formed by the two side panels 12 and 14, back panel 18 and bottom 20 to limit the arc through which the top is capable of pivoting to less than 135°.

FIG. 2 also shows one of a pair of arcuate slots 64 each centered on the pivot axis 30 of the front panel 16. The slots 64 are respectively formed in the side panels 12 and 14 or in opposite sides of the front panel 16. They are preferably formed in the front panel 16 at opposite sides thereof, for example in a pair of flanges 66 lying in planes which are respectively perpendicular to the main portion of the front panel 16. A pair of limit pins 68 are formed respectively in the side panels 12 and 14 and ride in the slots 64 to limit the pivoting movement of the front panel.

Ridges are formed on the outside of the bottom 20 and complemental to the well 54, whereby the ridge means and well cooperate to facilitate stacking a plurality of files 10. The ridges are also complemental to a peripheral portion of the top 22. Specifically, the well 54 and the top 22 are both rectangular, and the ridges comprise a first pair of parallel ridges 80 and 81 (FIGS. 1 and 2) respectively cooperating with opposite sides of the well 54' of a next lower file 10' (FIG. 2) and a second pair of parallel ridges 82 and 83 respectively cooperating with opposite sides of the top 22' of the file 10'. The ridges 80 and 81 of the first pair are perpendicular to the ridges 82 and 83 of the second pair.

Buttress means 86, 88 (FIGS. 1, 2 and 3) cooperates with the side panels 12 and 14 and the top 22 for preventing the top 22 from overriding the side panels 12 and 14 and front panel 16 when subjected to pressure in the closed position. The buttress comprises a pair of flanges 88 respectively connected to the side panels 12 and 14 and each lying in a horizontal plane and a pair of flanges 86 respectivley connected to the top at opposite sides thereof and each lying in a vertical plane. The flanges 86 of one pair respectively abut the flanges 88 of the other pair in the closed position.

Thus there is provided in accordance with the invention a novel and highly-effective portable file case that expands when in use to permit finger access to hanging files stored therein, even when the several hanging files and the file case itself are filled to rated capacity, and that retracts to a closed position for compact storage. Many modifications of the preferred embodiment of the invention disclosed herein will readily occur to those skilled in the art. For example, it is possible to form the limit pins 68 in the front panel flanges and to form the arcuate slot 64 in the side panels 12 and 14. Accordingly, the invention is to be construed as including all structure which falls within the scope of the appended claims.

What is claimed is:

1. A portable file comprising a case formed with two side panels, a front panel, a back panel, bottom and a top, said two side panels, back panel and bottom forming an integral structure, first hinge means connecting said integral structure and the rear end of said top and permitting pivoting movement of said top about said hinge means between a closed position and an open position, second hinge means connecting said integral structure and the bottom of said front panel and permitting pivoting movement of said front panel about said second hinge means between a closed position and an extended position, latch means connected to said top and front panel whereby they can releaseably be retained in their respective closed positions, handle means connected to said top whereby it can be carried, support means formed on said side panels for supporting a plurality of hanging files inside said case, said support means comprising the upper edges of said respective side panels, retention means comprising a pair of shoulders formed on said top and being spaced apart from said upper edges when said top is in said closed position a distance sufficient to permit said files to hang over said respective upper edges but insufficient to permit said files to become dislodged from said respective upper edges, said retention means cooperating with said support means for retaining said hanging files on said support means when said top is in said closed position, notwithstanding tipping of said case, and buttress means cooperating with said side panels and said top for preventing said top from overriding said side panels and front panel when subjected to pressure in the closed position, said buttress means comprising a pair of flanges respectively connected to and extending outwardly from said side panels below the upper edges thereof and a pair of flanges respectively connected to said top at opposite sides thereof, the flanges of one pair respectively abutting the flanges of the other pair in the closed position, said top being capable of pivoting through an arc exceeding 90°, whereby it rests stably in the open position by virtue of its own weight, and said front panel being capable of pivoting through an arc such that the top thereof in said extended position swings out a distance sufficient to permit finger access to hanging files stored in said case even when said case is filled to rated capacity.

2. A file according to claim 1 wherein said first hinge means is connected to said two side panels.

3. A file according to claim 1 wherein said first hinge means comprises a pair of pivot pins each connecling one of said side panels to said top.

4. A file according to claim 1 wherein said second hinge means is connected to said two side panels.

5. A file according to claim 1 wherein said second hinge means comprises a pair of pivot pins each connecting one of said side panels and said front panel.

6. A file according to claim 1, wherein said latch means comprises a U-shaped member pivotally attached to one of said top and front panel and means integrally formed on the other of said top and front panel engageable with said U-shaped member on the inside of the U thereof.

7. A file according to claim 1 wherein said lop is formed with a well and said handle means is pivotally attached to said top and adapted to be pivoted between an extended position in which it can be grasped for carrying and a storage position in which it is wholly accommodated within said well.

8. A file according to claim 7 wherein said handle means is formed with finger-hold means facilitating grasping of said handle means in said storage position.

9. A file according to claim 7 wherein said handle means is formed with recess means facilitating grasping of said handle means in said storage position.

10. A file according to claim 7 wherein said handle means can be pivoted in either of two directions from said extended position to said storage position.

11. A file according to claim 7 wherein said handle means in said storage position is flush with said top.

12. A file according to claim 7 further comprising a pair of pivot pins each connecting said handle means to said top.

13. A file according to claim 12 wherein said pivot pins are integral with said handle means and are respectively adapted to be inserted into a pair of apertures respectively formed in opposite sides of said well and wherein said handle means is generally U-shaped and formed of polystyrene, whereby said handle means (a) can be readily assembled with said top by inserting one of said pivot pins into one of said apertures and then sliding the other pivot pin along the opposite side of said well until it pops into the other of said apertures but (b) does not readily become detached from said top and can be safely used for carrying said file even when said file is filled to rated capacity.

14. A file according to claim 1 wherein said top engages said integral structure to limit said arc through which said top is capable of pivoting to less than 135.

15. A file according to claim 1 further comprising:

a pair of arcuate slots each centered on the pivot axis of said front panel and formed in one of said side panels and a pair of limit pins each formed on said front panel, each of said limit pins riding in one of said slots to limit the pivoting movement of said front panel.

16. A file according to claim 15 wherein said slots are formed in said front panel at opposite sides thereof and said limit pins are respectively formed on said side panels.

17. A file according to claim 16 wherein said front panel is formed with integral flanges at opposite sides thereof, said flanges lying in planes which are respectively perpendicular lo the main portion of said front panel, and said slots being respectively formed in said flanges.

18. A files according to claim 7 further comprising ridge means formed on the outside of said bottom and complemental to said well, whereby said ridge means and well cooperate to facilitate stacking a plurality of such files.

19. A file according to claim 18 wherein said ridge means is also complemental to a peripheral portion of said top.

20. A file according to claim 19 wherein said well and said top are both rectangualr and wherein said ridge means comprises a first pair of parallel ridges respectively cooperating with opposite sides of said well and a second pair of parallel ridges respectively cooperating with opposite sides of said top, the ridges of said first pair being perpendicular to the ridges of said second pair.

21. A file according to claim 1 further comprising:

a pair of arcuate slots each centered on the pivot axis of said front panel and formed in said front panel and a pair of limit pins each formed on one of said side panels, each of said limit pins riding in one of said slots to limit the pivoting movement thereof.

* * * * *